US008710994B2

(12) United States Patent
Chan

(10) Patent No.: US 8,710,994 B2
(45) Date of Patent: Apr. 29, 2014

(54) FLOOD PROTECTION APPARATUS AND CONTAINER DATA CENTER INCLUDING THE SAME

(75) Inventor: Hung-Chou Chan, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 579 days.

(21) Appl. No.: 12/978,597

(22) Filed: Dec. 26, 2010

(65) Prior Publication Data

US 2012/0126990 A1 May 24, 2012

(30) Foreign Application Priority Data

Nov. 19, 2010 (TW) ..... 099140085

(51) Int. Cl.
*G08B 21/00* (2006.01)

(52) U.S. Cl.
USPC ..... 340/618; 410/46

(58) Field of Classification Search
USPC ..... 119/673; 210/242.1; 33/522; 702/50; 211/162; 410/46; 340/613, 618
See application file for complete search history.

(56) References Cited

U.S. PATENT DOCUMENTS

| | | | | |
|---|---|---|---|---|
| 5,217,611 | A * | 6/1993 | Ayroldi | 210/242.1 |
| 6,041,512 | A * | 3/2000 | Wacke | 33/522 |
| 7,198,007 | B2 * | 4/2007 | Bestelmeyer | 119/673 |
| 2004/0067118 | A1 * | 4/2004 | Kim | 410/46 |
| 2006/0241874 | A1 * | 10/2006 | Carter | 702/50 |
| 2009/0050591 | A1 * | 2/2009 | Hart et al. | 211/162 |

FOREIGN PATENT DOCUMENTS

| | | |
|---|---|---|
| TW | 295994 | 1/1997 |
| TW | M359533 U1 | 6/2009 |

* cited by examiner

*Primary Examiner* — Steven Lim
*Assistant Examiner* — Kaleria Knox
(74) *Attorney, Agent, or Firm* — Novak Druce Connolly Bove + Quigg LLP

(57) ABSTRACT

A flood protection apparatus includes an adjustable base, a first water level detector, and a controller. The adjustable base supports the container and is operable to adjust a height of the container. The first water level detector is mounted on the base. When the first water level detector detects water has reached the first level, the first water level detector outputs a first detection signal. The controller receives the first detection signal to activate the base to heighten the container, until the first detection signal ceases or the base is at a highest point.

11 Claims, 3 Drawing Sheets

FLOOD PROTECTION APPARATUS AND CONTAINER DATA CENTER INCLUDING THE SAME

BACKGROUND

1. Technical Field

The present disclosure relates to a flood protection apparatus and a container data center including the flood protection apparatus.

2. Description of Related Art

Once container data centers are mounted on bases, the height of the container data centers are fixed. Moreover, because the container data centers are located outdoors, they are at risk of damage from floods.

BRIEF DESCRIPTION OF THE DRAWINGS

Many aspects of the present embodiments can be better understood with reference to the following drawings. The components in the drawing are not necessarily drawn to scale, the emphasis instead being placed upon clearly illustrating the principles of the present embodiments. Moreover, in the drawing, all the views are schematic, and like reference numerals designate corresponding parts throughout.

DETAILED DESCRIPTION

The disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
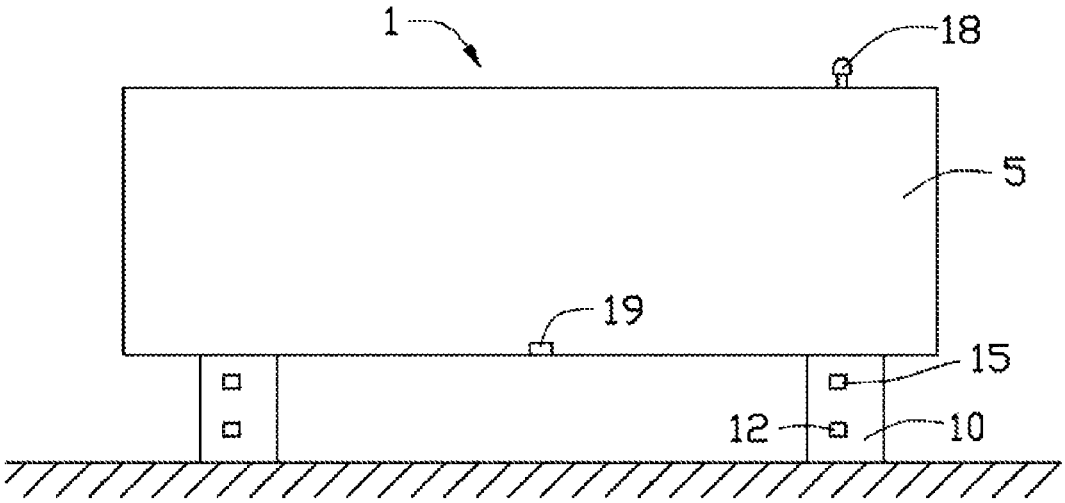
FIG. 1 is a schematic diagram of an exemplary embodiment of a container data center.
Figure 2:
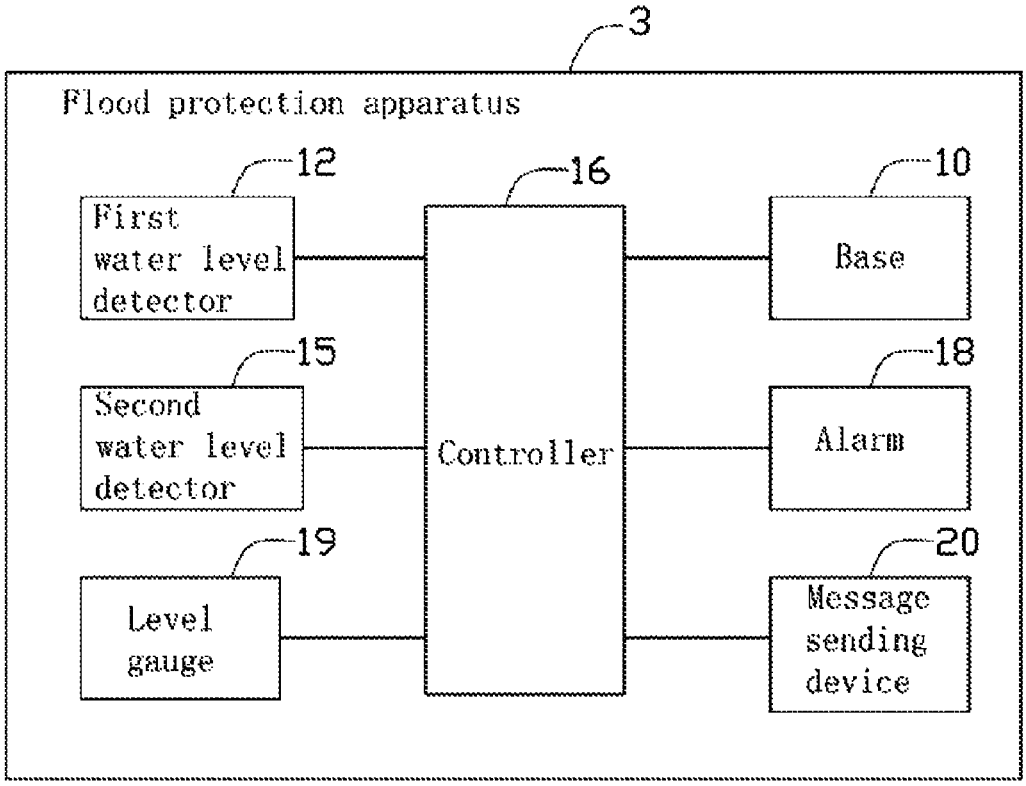
FIG. 2 is a block diagram of an exemplary embodiment of a flood protection apparatus of the container data center of FIG. 1.

Referring to FIGS. 1 and 2, an exemplary embodiment of a container data center 1 includes a movable container 5, a plurality of servers (not shown) accommodated in the container 5, and a flood protection apparatus 3 mounted in the container 5.

The flood protection apparatus 3 includes an adjustable base 10, a first water level detector 12, a second water level detector 15, a controller 16, an alarm 18, a level gauge 19, and a message sending device 20.

Figure 3:
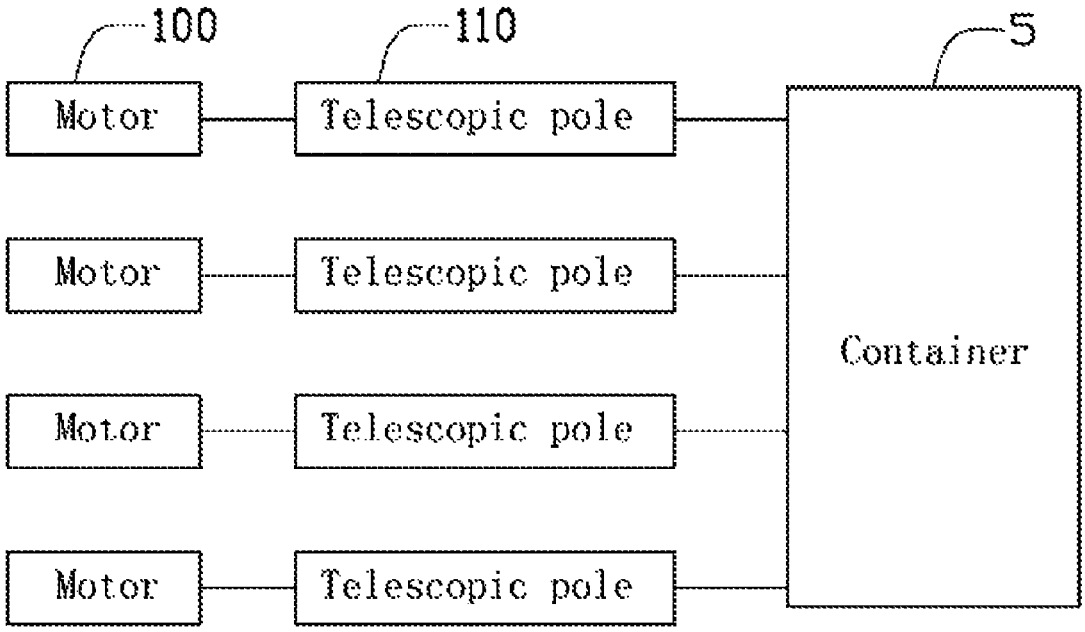
FIG. 3 is a block diagram of the container data center of FIG. 1.

The base 10 is located under the container 5 for supporting the container 5 and adjusting a height of the container 5. Referring to FIG. 3, in the embodiment, the base 10 includes four motors 100 and four telescopic poles 110. Each telescopic pole 110 is connected to one of the motors 100. The four telescopic poles 110 are mounted under four corners of the container 5 respectively. Each telescopic pole 110 can be driven by the corresponding motor 100 to be extended or retracted, thus to adjust the height of the container 5.

The first water level detector 12 and the second water level detector 15 are mounted on the base 10 at different heights. In the embodiment, the first water level detector 12 is lower than the second water level detector 15. When the first water level detector 12 detects water has reached the first water level, the first water level detector 12 outputs a first detection signal to the controller 16. When the second water level detector 15 detects water has reached the second water level, the second water level detector 15 outputs a second detection signal to the controller 16. In the embodiment, the first water level detector 12 and the second water level detector 15 may be float type level switches.

The controller 16 receives the first and second detection signals and controls the base 10, the alarm 18, and the message sending device 20 accordingly. In particular, when the controller 16 receives the first detection signal, the controller 16 controls the motors 100 to drive the telescopic poles 110 of the base 10 to be extended, thus to raise the container 5, until the first detection signal ceases or the telescopic poles 110 are at a maximum length. Moreover, the controller 16 controls the message sending device 20 to send a message, such as an SMS message to a phone. When the controller 16 receives the second detection signal, the controller 16 activates the alarm 18, and controls the message sending device 20 to send a message to the phone. In the embodiment, because the first water level detector 12 is lower than the second water level detector 15, thus the controller 16 receives the second detection signal, the controller 16 will still be receiving the first detection signal. At this time, when the controller 16 is receiving both the first and second detection signals, the controller 16 activates the alarm 18, and controls the message sending device 20 to send a message to the phone.

In the embodiment, the message sending device 20 is a global system for mobile communications (GSM) modem. When the controller 16 receives the second detection signal, the GSM modem sends a preset message to the phone or in other embodiments more than one phone, to alter users.

The level gauge 19 is mounted in the container 5 to determine whether the container 5 is horizontal. If the level gauge 19 determines that the container 5 is not horizontal, the level gauge 19 outputs a corresponding signal to the controller 16. The controller 16 controls the base 10 to level the container 5 horizontal. For example, the level gauge 19 determines that the container 5 is leaning to the left, the level gauge 19 outputs the corresponding signal to the controller 16. The controller 16 controls the motors 100 to raise the two telescopic poles 110 at the two left corners of the container 5 until the level gauge 19 determines that the container 5 is level. If the level gauge 19 determines that the container 5 is leaning to the right, the controller 16 controls the motors 100 to raise the two telescopic poles 110 at the two right corners of the container 5 until the level gauge 19 determines that the container 5 is level. Thus, the container 5 is protected from flooding.

The foregoing description of the exemplary embodiments of the disclosure has been presented only for the purposes of illustration and description and is not intended to be exhaustive or to limit the disclosure to the precise forms disclosed. Many modifications and variations are possible in light of the above everything. The embodiments were chosen and described in order to explain the principles of the disclosure and their practical application so as to enable others of ordinary skill in the art to utilize the disclosure and various embodiments and with various modifications as are suited to the particular use contemplated. Alternative embodiments will become apparent to those of ordinary skills in the art to which the present disclosure pertains without departing from its spirit and scope. Accordingly, the scope of the present disclosure is defined by the appended claims rather than the foregoing description and the exemplary embodiments described therein.

What is claimed is:

1. A flood protection apparatus used for a container data center, the container data center comprising a movable container, the flood protection apparatus comprising:

an adjustable base to support the container and to adjust a height of the container;

a first water level detector mounted on the adjustable base, wherein when the first water level detector detects water has reached a first water level, the first water level detector outputs a first detection signal;

a controller to receive the first detection signal to activate the adjustable base to raise the container, until the first detection signal terminates or the adjustable base is at a highest point;

an alarm; and a second water level detector, wherein the second water level detector is mounted on the adjustable base and higher than the first water level detector, when the second water level detector detects water has reached a second water level, the second water level detector outputs a second detection signal, and the controller activates the alarm according to the second detection signal.

2. The flood protection apparatus of claim 1, wherein the adjustable base comprises four telescopic poles and four motors, the four telescopic poles are mounted under four corners of the container, each motor is connected to a corresponding telescopic pole to extend or retract the telescopic pole.

3. The flood protection apparatus of claim 1, further comprising a message sending device, wherein the controller activates the message sending device to send a message to a phone according to the first detection signal.

4. The flood protection apparatus of claim 1, further comprising a message sending device, wherein the controller activates the message sending device to send a message to a phone according to the second detection signal.

5. The flood protection apparatus of claim 1, further comprising a level gauge, wherein the level gauge is mounted in the container to determine whether the container is horizontal, when the container is not horizontal, the level gauge outputs a sensing signal to the controller to control the adjustable base to level the container.

6. A container data center comprising:

a movable container; and a flood protection apparatus comprising:

an adjustable base to support the container and to adjust a height of the container;

a first water level detector mounted on the adjustable base, wherein when the first water level detector detects water has reached a first water level, the first water level detector outputs a first detection signal;

a controller to receive the first detection signal to activate the adjustable base to raise the container, until the first detection signal terminates or the adjustable base be is a highest point;

an alarm; and a second water level detector, the second water level detector is mounted on the adjustable base and higher than the first water level detector, when the second water level detector detects water has reached a second water level, the second water level detector outputs a second detection signal, and the controller activates the alarm according to the second detection signal.

7. The container data center of claim 6, wherein the adjustable base comprises four telescopic poles and four motors, the four telescopic poles are mounted under four corners of the container, each motor is connected to a corresponding telescopic pole to extend or retract the telescopic pole.

8. The container data center of claim 6, wherein the flood protection apparatus further comprises a message sending device, the controller activates the message sending device to send a message to a phone according to the first detection signal.

9. The container data center of claim 6, wherein the flood protection apparatus further comprises a message sending device, the controller activates the message sending device to send a message to a phone according to the second detection signal.

10. The container data center of claim 6, wherein the flood protection apparatus further comprises a level gauge, the level gauge is mounted in the container to determine whether the container is horizontal, when the container is not horizontal, the level gauge outputs a sensing signal to the controller to control the adjustable base to level the container.

11. The container data center of claim 10, wherein the adjustable base comprises four telescopic poles and four motors, the four telescopic poles are mounted under four corners of the container, each motor is connected to a corresponding telescopic pole to extend or retract the telescopic pole according the sensing signal.

* * * * *